United States Patent [19]

Schoepe

[11] 4,422,441

[45] Dec. 27, 1983

[54] DISPOSABLE STACKABLE SPLATTER SHIELD AND FRAME THEREFORE

[76] Inventor: Erich G. Schoepe, P.O. Box 842 Station 'A', Scarborough, Ontario, Canada

[21] Appl. No.: 275,821

[22] Filed: Jun. 22, 1981

[51] Int. Cl.[3] ..... F24C 15/20

[52] U.S. Cl. ..... 126/299 C; 220/252

[58] Field of Search ..... 126/299 C, 299 R, 214; 220/252, 85 H, 3.5; 160/132, 134; 52/86; 46/1 L; 296/219–222

[56] References Cited

U.S. PATENT DOCUMENTS

| | | | |
|---|---|---|---|
| 1,126,236 | 1/1915 | Lees | 160/132 |
| 2,080,786 | 5/1937 | Robles | 220/252 |
| 2,250,729 | 7/1941 | Smith et al. | 220/252 |
| 3,229,846 | 1/1966 | Katz | 220/252 |
| 4,359,842 | 11/1982 | Hooker | 52/18 |

FOREIGN PATENT DOCUMENTS

| | | | |
|---|---|---|---|
| 653204 | 11/1962 | Canada | 46/1 L |

*Primary Examiner*—James C. Yeung

*Attorney, Agent, or Firm*—Kerry Maxwell Hill

[57] ABSTRACT

A semi-permanent and collapseable shield of metal foil is pleated concertina-like to present a U-shaped half circular body capable when open, to surround a stove heating element and a cooking pot thereon, to catch the splatter from the pot. The shield is capable of being stacked with other shields for packaging in multiples.

1 Claim, 2 Drawing Figures

DISPOSABLE STACKABLE SPLATTER SHIELD AND FRAME THEREFORE

FIELD OF INVENTION

The present invention relates to a splatter guard or cooking shield assembly for positioning about a source of heat such as an electric or gas heating element and for partially encircling a cooking vessel placed on said element.

In particular the invention provides semi-permanent and disposable and collapseable splatter shileds so pleated as to present a u-shaped half circular body capable of being stacked for packaging in multiples. The pleated shields are made of aluminium or other metallic foil adapted to be fitted to a frame for additional rigidity if desired when in surrounding position about a heating source but the pleated and folded foil can be set up to stand alone to receive the splatter from the vessel on the heat source.

BACKGROUND OF THE INVENTION

It is known that most cooks are fastidious concerning vapours and greases emanating from vessels of food cooking on a stove surface. Hoods and fans are provided in most modern kitchens to drive off part of the smoke and vapours from the cooking areas above the stove. Closed ovens are often preferred by many cooks to retain splatter from cooking operations especially of meat products. It is known that frying is a fast method of cooking many foods but it is recognized that frying generates a great amount of splatter. There is a need for a device that will contain and catch the undesirable splatter from a small area immediately surrounding a cooking vessel and its heat source.

OBJECTS OF THE INVENTION

It is the principal object of the present invention to provide a means for surrounding a cooking vessel on a heating surface to catch and hold any grease, oil and vapours splattering from the vessel. It is another object of the invention to fabricate the splatter catching means from aluminium foil or the like and to pleat and fold the foil accordian like to collapse for ease of packaging and storage and to adapt the foil means to fit over a frame designed to hold it concertina fashion for placing about the heating element of a stove.

SUMMARY OF THE INVENTION

A splatter shield assembly for positioning around a source of heat such as a stove element is fabricated from metallic foil so pleated as, when collapsed presents an accordian pleated u-shaped form capable of being stacked and packaged in multiples, and when the pleats are opened presents an open fronted enclosure of quasi-sherical configuration. The open front is adapted to receive a cooking vessel.

Alternatively the shield can be provided with a frame assembly comprising two essentially similar u-shaped supports having free sides and hingeably connected at their open ends to maintain the supports in either a closed or collapsed position in which said supports lie flat against one another or in an open position at right angles to each other. Clamp means are provided the frame to secure the edge pleat of the foil means onto the frame. The clamp means are manually fitted and released from the frame to allow the operator to dispose of a used foil and to replace it with a new one.

IN THE DRAWINGS

With the foregoing objects in view and such other objects that become apparent from consideration of this disclosure, the present invention consists of the inventive concept which is comprised, embodied and included in the construction, method and combination of parts herein exemplified reference being had to the accompanying drawings in which like reference numerals refer to like parts.

DESCRIPTION OF THE PREFERRED EMBODIMENT OF THE INVENTION

Figure 1:
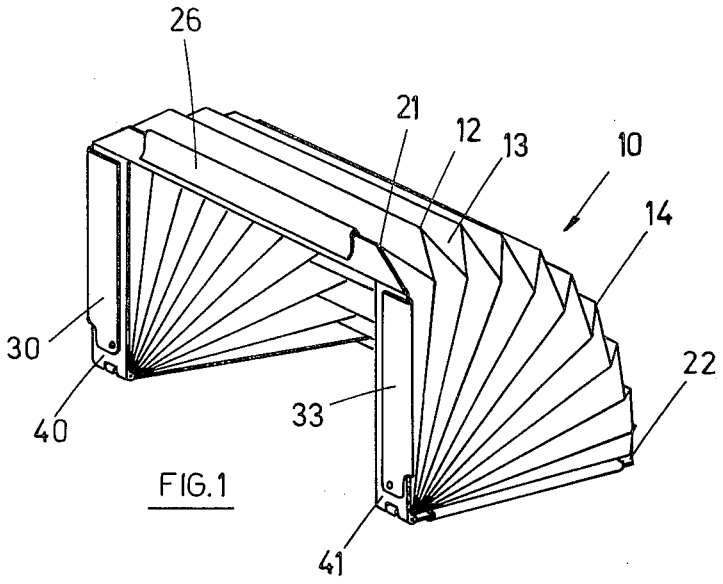
FIG. 1 is a front perspective view of of a pleated and outfolded shield of metallic foil shown attached at its peripheral edges to a u-shaped pair of support members comprising a frame for the foil.

In FIG. 1 numeral 10 designates a sheet of aluminum foil that has been pleated as at 12,13, to form a concertina or accordian shape throughout its surface. The pleated foil has also been has had major portions of its body folded as at 14 to form the foil into a self-supporting u-shaped hemispherical or quasi-quadri-cylindrical form that will sit upon a stove top to surround a heating element to act as a splatter guard for the stove and cooking vessel set thereon. The splatter guard can be outfolded to completely enclose the vessel or can be partly open at front as shown in FIG. 1. Once pleated and side fold 14 created in the pleats, the splatter guard 10 can be collapsed to lie flat for storage in a supermarket and a home shelf. For use the guard is merely pulled out accordian fashion and set in place.

Figure 2:
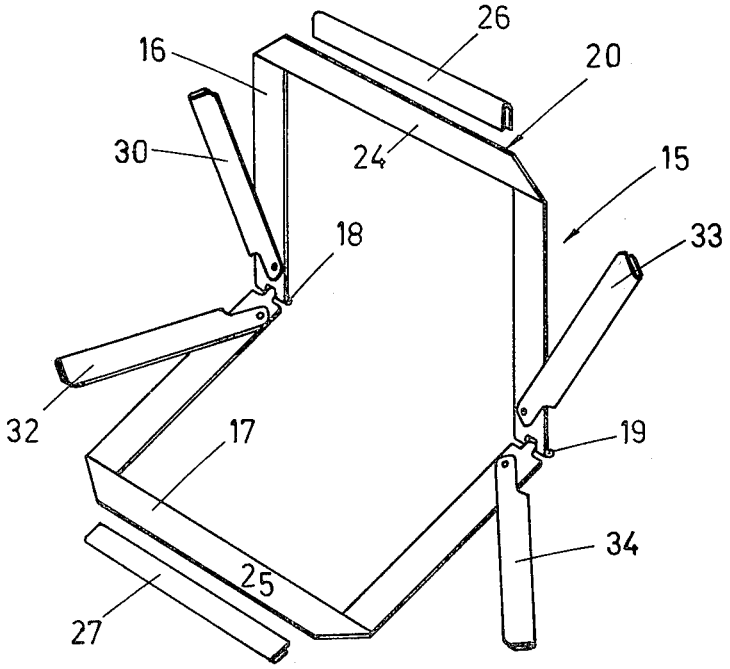
FIG. 2 is a view of the frame for the splatter guard foil showing the pivotable mode of attaching the shield clamp to the frame supports and showing the end claps exploded from the side or end parts of the supports where they interfit to hold the edge pleat of the foil in clamping relation to the frame.

To provide a more stable product the edge pleats, top, bottom, and sides can be attached to a frame as shown in FIG. 1. The frame is shown without the pleated foil cover in FIG. 2 as numeral 15. The frame 15 consists of a pair of u-shaped flat sheet metal members 16,17 higed together by friction hinges 18,19. The side edges 20, of the frame supports 16,17 are very thin to allow for easy fitting of the pleats of the foil guard edges to the frame. The toppleat 21, and the bottom pleat 22 of a foil member are secured to the cross member of each support 24,25 as shown and are held there by u clamps 26 and 27.

Clamps 30,32, 33, 34, are pivotably attached to one of the side arms of the u-shaped support members of the frame as shown. The pivots are located adjacent the hinges 18,19 of the supports 16,17, of the frame. The clamps 30,32,33,34, are adapted to infold over the sides of the frame to retain the infolded pleated sides of the splatter guard on the frame when in use therewith.

In FIG. 1, the pleat 41 is shown held by clamp 33 and the side pleat 40 opposite 41 is held by clamp 30 to the frame.

When the foil becomes covered with splatter from the cooking operation the foil 10 is easily removed and replaced from the support frame 15 by manually unclamping the clamps 26,27, 30,32, 33 and 34. The used foil is folded and disposed of and a new one outfolded from the neat stack of multiple foils packaged together.

What I claim is:

1. In a splatter or cooking-shield assembly for positioning around and over a source of heat such as an electric cooking element, and for partially enclosing a vessel placed on said element, comprising;

a semi-permanent disposable, collapseable shield of metallic foil formed into pleated walls and presenting, when collapsed, an accordian-shaped approximately U-shaped or half circular body capable of being stacked and packaged in multiples, and when opened presenting an open-fronted enclosure of approximately quadri-cylindrical or quadri-spherical configuration, said walls creating a free standing shield;

a frame for said shield comprising two essentially similar and approximately U-shaped or half circular shaped supporting elements, having free ends hingeably connected so as to maintain said elements in a closed or collapsed position in which said elements lie flat and interfacing or an open position at right angles to each other; and clip means for attaching said shield to said frame.

* * * * *